United States Patent [19]

Kitamura et al.

[11] Patent Number: 4,558,543

[45] Date of Patent: Dec. 17, 1985

[54] MOVING APPARATUS FOR A PNEUMATICALLY SUPPORTED MEMBRANE STRUCTURE

[75] Inventors: Hiroshi Kitamura, Ichikawa; Kaoru Nishikawa; Masamitsu Naito, both of Tokyo, all of Japan

[73] Assignee: Taisei Kensetsu Kabushiki Kaisha, Tokyo, Japan

[21] Appl. No.: 724,805

[22] Filed: Apr. 19, 1985

Related U.S. Application Data

[63] Continuation of Ser. No. 479,076, Mar. 25, 1983, abandoned.

[30] Foreign Application Priority Data

Jul. 27, 1982 [JP] Japan ..... 57-129666

[51] Int. Cl.[4] ..... E04B 1/345

[52] U.S. Cl. ..... 52/2; 52/64; 52/143

[58] Field of Search ..... 52/2, 64, 143; 135/103

[56] References Cited

U.S. PATENT DOCUMENTS

| | | | |
|---|---|---|---|
| 2,744,581 | 5/1956 | Cooper | 52/64 |
| 3,534,511 | 10/1970 | Cappella | 135/103 X |
| 3,783,766 | 1/1974 | Boucher | 52/2 |
| 3,863,404 | 2/1975 | Wahlquist | 52/143 X |
| 3,885,360 | 5/1975 | Fraioli | 52/2 |
| 4,034,524 | 7/1977 | Fromme et al. | 52/143 X |
| 4,192,105 | 3/1980 | Morgan | 52/2 |
| 4,214,407 | 7/1980 | Charter | 52/2 |

FOREIGN PATENT DOCUMENTS

| | | | |
|---|---|---|---|
| 545731 | 3/1977 | U.S.S.R. | 52/2 |

*Primary Examiner*—J. Karl Bell

*Attorney, Agent, or Firm*—Wenderoth, Lind & Ponack

[57] ABSTRACT

A moving apparatus for a pneumatically supported membrane structure is described herein, which apparatus has a rigid movable frame disposed along a lower peripheral edge of a pneumatically supported membrane structure, the rigid movable frame being constructed in such manner that upon moving the pneumatically supported membrane structure, the structure can be moved while maintaining its shape under the condition that said frame is separated upwardly from a floor surface on which the structure is moved.

3 Claims, 15 Drawing Figures

MOVING APPARATUS FOR A PNEUMATICALLY SUPPORTED MEMBRANE STRUCTURE

Figure 1:
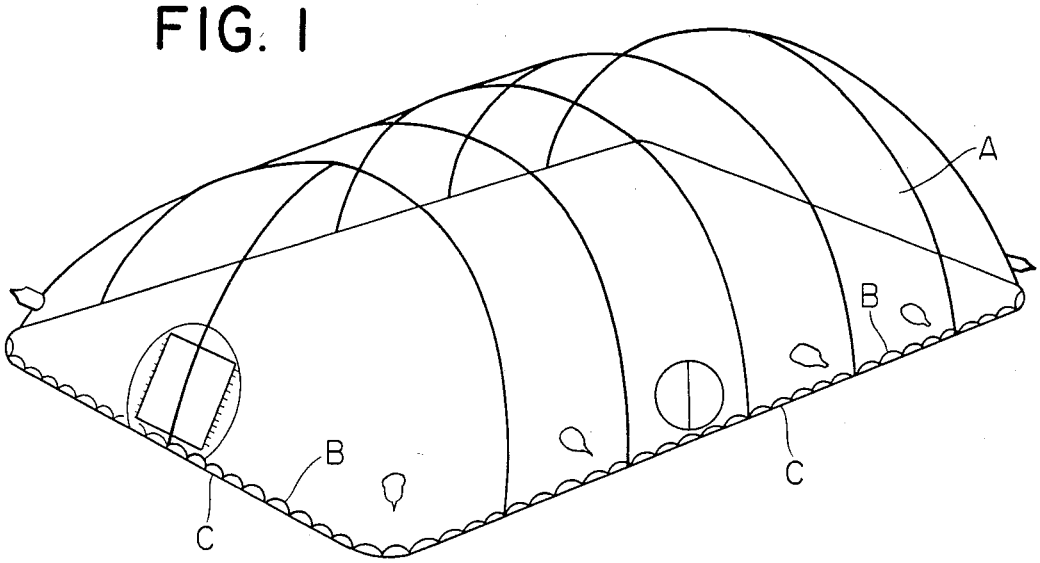

This application is a continuation of now abandoned application Ser. No. 479,076, filed Mar. 25, 1983.

The present invention relates to a moving apparatus for a pneumatically supported membrane structure consisting of a single layer membrane.

A single layer membrane structure has a great advantage in that installation is easy and the cost is low.

However, because the membrane structure is a temporary structure, often it is necessary to move the membrane structure. In such a case, since leakage of air through the lower edge of the membrane material becomes large, resulting in failure to maintain the overall shape, and since it is inevitable that the membrane material will be trailed, it is a common practice that instead of moving it, the structure is dismantled and then again erected. The present invention has been proposed to resolve such technical problems in the prior art.

It is therefore one object of the present invention to provide a novel moving apparatus for a pneumatically supported membrane structure which makes it possible to move a pneumatically supported membrane structure without substantial leakage of air past the lower edge of the membrane material.

Another object of the present invention is to provide a novel moving apparatus for a pneumatically supported membrane structure which makes it possible to move a pneumatically shaped membrane structure without trailing the membrane material.

Still another object of the present invention is to provide a novel moving apparatus for a pneumatically supported membrane structure which makes it unnecessary to dismantle the structure and then again erect it.

According to one feature of the present invention, there is provided a moving apparatus for a pneumatically supported membrane structure comprising a rigid movable frame disposed along a lower peripheral edge of said pneumatically supported membrane structure constructed in such manner that upon moving said pneumatically supported membrane structure, said structure can be moved while maintaining its shape by lifting said frame upwardly from a floor surface on which said structure is moved.

Since the moving apparatus according to the present invention is constructed as described above, the pneumatically supported membrane structure can be moved to a desired position while maintaining the shape of the membrane structure by the frame at the lower portion of membrane material by applying a minimum inner pressure necessary for pushing the membrane member up at the lower edge portion of the structure to the interior of the membrane structure.

At this time, since provision is made for lifting said frame upwardly from a floor surface on which said structure is moved, the movement of the pneumatically shaped membrane structure can be effected easily, and in addition, a waterproof packing and the like mounted on the frame will not be trailed, and further, owing on the fact that the lower edge portion of the membrane member pushed up into the interior of the structure is engaged with the frame, the membrane member also will not be trailed.

After the pneumatically supported membrane structure has been moved to a predetermined position in the above-described manner, the frame is fixed at the predetermined position and the inner pressure is raised to such extent that it will support the membrane against wind pressure and fallen snow. It is to be noted that invasion of rain water and the like through the lower edge of the membrane member can be prevented by a water stoppage packing mounted at the bottom of the frame.

Figure 2:
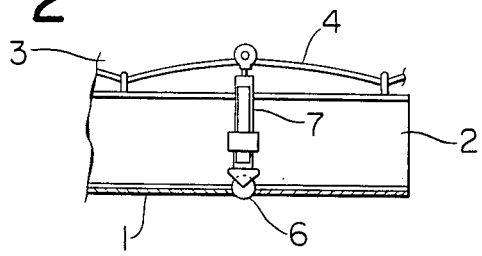
Figure 3:
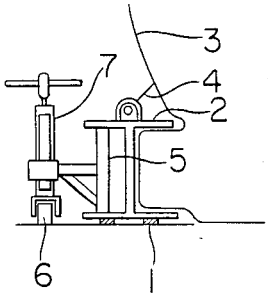
Figure 4:
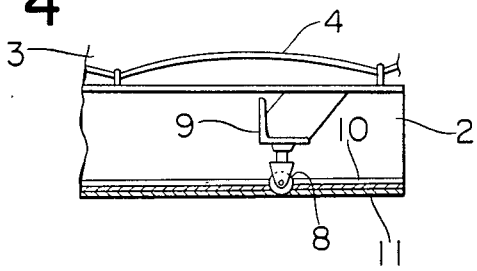
Figure 5:
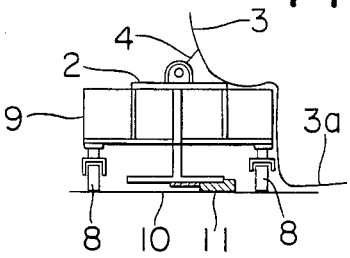
Figure 6:
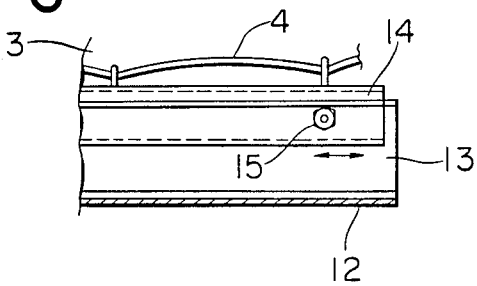
Figure 7:
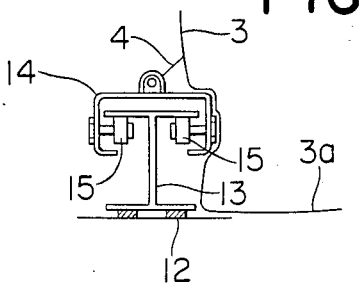
Figure 8:
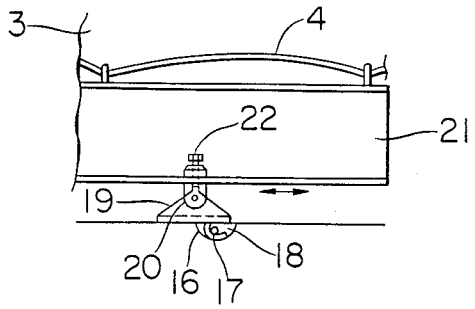
Figure 9:
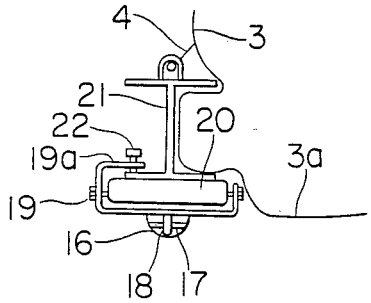
Figure 10:
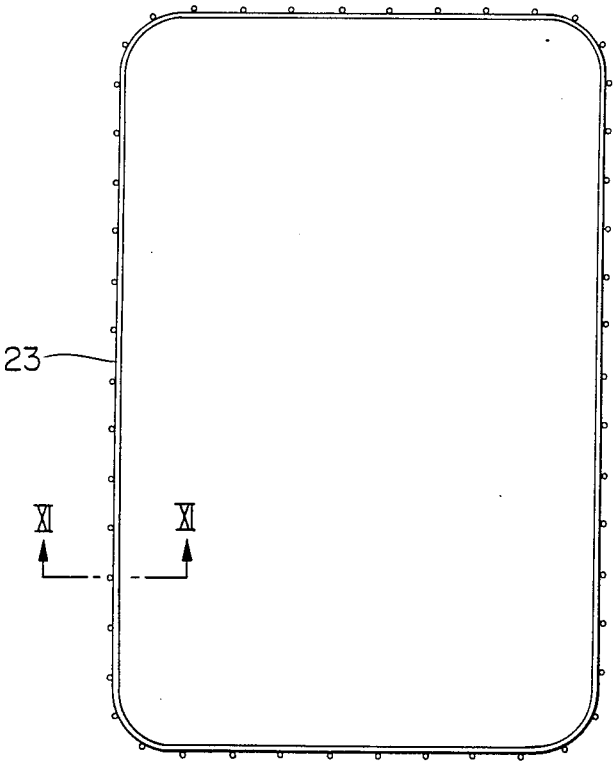
Figure 11:
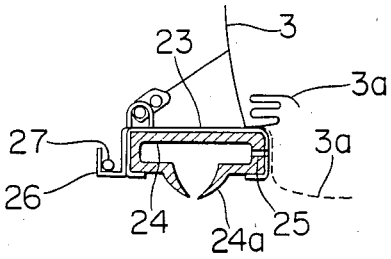
Figure 12:
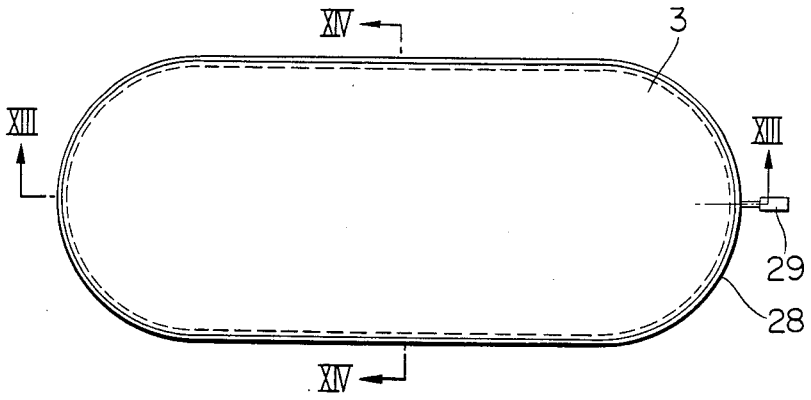
Figure 13:
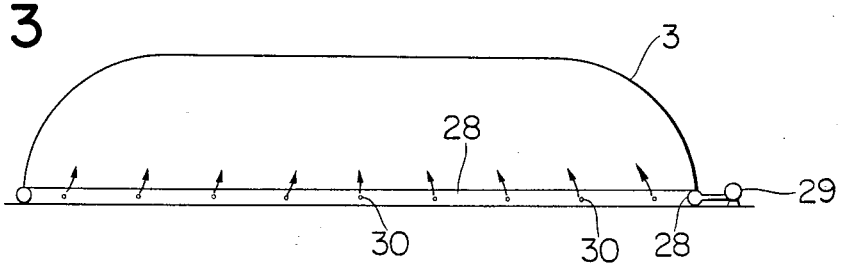
Figure 14:
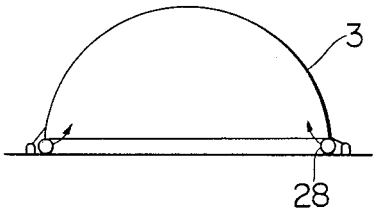
Figure 15:
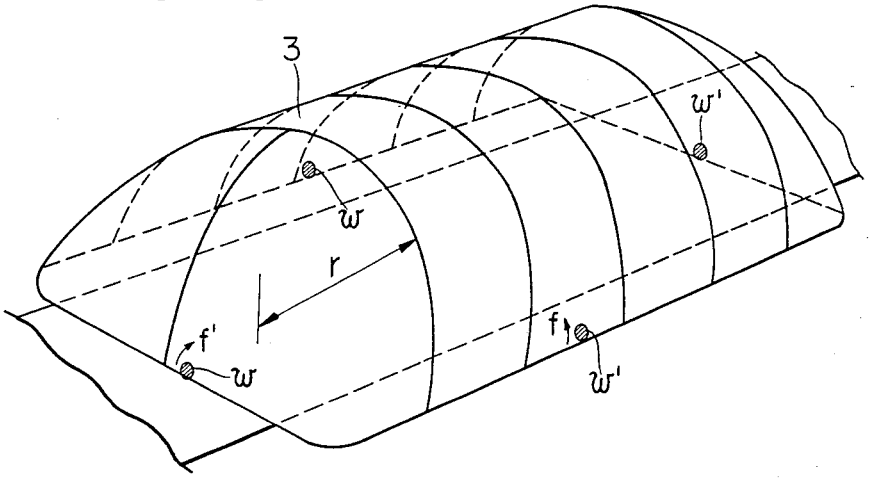

The above-described and other objects, features and advantages of the present invention will become more apparent by reference to the following description of preferred embodiments of the invention taken in conjunction with the accompanying drawings, wherein:

FIG. 1 is a perspective view showing an outline of a pneumatically supported membrane structure provided with a moving apparatus according to the present invention, FIG. 2 is a side elevation view of a first preferred embodiment of the present invention, FIG. 3 is a transverse cross-section view of the apparatus in FIG. 2, FIG. 4 is a side elevation view of a second preferred embodiment of the present invention, FIG. 5 is a transverse cross-section view of the apparatus in FIG. 4, FIG. 6 is a side elevation view of a third preferred embodiment of the present invention, FIG. 7 is a transverse cross-section view of the apparatus in FIG. 6, FIG. 8 is a side elevation view of a fourth preferred embodiment of the present invention, FIG. 9 is transverse cross-section view of the apparatus in FIG. 8, FIG. 10 is a plan view of a fifth preferred embodiment of the present invention, FIG. 11 is a cross-section view taken along line XI—XI in FIG. 10 as viewed in the direction of the arrows, FIG. 12 is a plan view of a sixth preferred embodiment of the present invention, FIG. 13 is a cross-section view taken along line XIII—XIII in FIG. 12 as viewed in the direction of the arrows, FIG. 14 is a cross-section view taken along line XIV—XIV in FIG. 13 as viewed in the direction of the arrows, and FIG. 15 is a perspective view showing a seventh preferred embodiment of the present invention.

Referring now to FIG. 1, an outline of a pneumatically supported membrane structure provided with the apparatus according to the present invention is illustrated, in which a rigid frame (C) is mounted on the lower edge of a membrane material (A) by means of catenary ropes (B).

A first preferred embodiment of the moving apparatus for a pneumatically supported membrane structure according to the present invention is illustrated in FIGS. 2 and 3, in which the frame is an H-shaped steel frame (2) having water stoppage packings (1) secured to its bottom flange is mounted to a membrane material (3) of the pneumatically supported membrane structure attached thereto by catenary ropes 4, and a wheeled supporting means by which said frame is supported on the ground or a floor, here comprising screw jack 7 having a foot wheel 6 has a vertically adjustable support member 5 connected between upper and lower flanges of the frame (2).

Normally, a skirt material (3*a*) disposed at the lower end portion of the membrane material (3) is tightly urged against a floor surface by the pneumatic pressure within the pneumatically supported membrane structure, and owing to pressure contact of the water stoppage packings (1) on the floor surface, invasion of rain water through the lower edge of the membrane material (3) can be prevented.

For moving, the structure, the frame (2) and the water stoppage packings (1) are both raised above the floor surface by operating the screw jack (7), and a minimum inner pressure necessary to make the skirt material fold against and engage with the flange of the frame 2 is applied to the interior of the membrane, and the pneumatically supported membrane structure is the moved to a predetermined position by rolling the foot wheel 6 along the floor surface while maintaining the shape of the membrane structure by the pneumatic pressure.

After completion of movement, the skirt material (3*a*) is let fall on the floor surface, the frame (2) is lowered and the water stoppage packings 1 are brought into pressure contact with the floor surface by operating the screw jack (7), and the inner pressure within the membrane material is raised up to a pressure that can resist wind pressure and fallen snow.

A second preferred embodiment of the present invention is illustrated in FIGS. 4 and 5, in which a horizontal member (9) provided with foot wheels (8) extends laterally from a web section of an H-shaped frame (2), and on the bottom of the lower flange of the frame (2) is mounted an air-leakage reducing packing (10) beneath which is wedged a water stoppage package (11). For moving the structure, the water stoppage package (11) is removed, the skirt member (3*a*) is folded and engaged with the frame (3), and the pneumatically shaped membrane structure is moved by rolling it on the foot wheels (8) while maintaining the shape of the membrane structure by the frame (2). It is to be noted that in the drawings, component parts equivalent to those of the above-described embodiments are given like reference numerals.

A third preferred embodiment of the present invention is illustrated in FIGS. 6 and 7, in which a rail (13) made of an H-shaped steel member having a water stoppage packing (12) secured to the bottom of its lower flange is laid on a floor surface, rollers (15) are rotatably mounted respectively on the opposite depending pieces of a C-shaped steel frame (14) having its side open, which frame is mounted on the lower edge of a membrane material (3) by means of catenary ropes (4), and the respective rollers (15) are brought into contact with the bottom surface of the upper flange of the rail (13) so as to freely roll along the bottom surface.

A fourth preferred embodiment of the present invention is illustrated in FIGS. 8 and 9, in which horizontal cylindrical rollers (20) are rotatably mounted between the opposite side pieces of groove-shaped metal members (19) engaged via engaging metal member (18) with horizontal pins (17) which are laterally mounted within recesses (16) provided in a floor surface. Rollable on roller (20) is an H-shaped steel frame (21) which is fixed to a membrane member (3) by catenary ropes (4). Upon movement, a skirt material (3*a*) is folded and engaged with the frame (21), at the same time the frame (21) is made to roll over the rollers (20), and after the frame has moved to a predetermined position, the lower flange of the frame (21) is fastened to the rollers (20) by means of screws (22) threadedly mounted on horizontal pieces 19*a* extending from the upper end of one side piece of the groove-shaped metal member (19).

A fifth preferred embodiment of the present invention is illustrated in FIGS. 10 and 11, in which a frame (23) made of a C-shaped steel member and having its bottom side open is mounted on a membrane material (3) by catenary ropes (4). An elastic member 24 made of rubber or the like and with a hollow rectangular cross-section and provided with a protrusion (24*a*) having a conical cross-section open at its bottom along a center of a bottom of the members, is tightly inserted within the frame (23), and an air passage hole (25) is provided through one side of the elastic member (24) and the side piece of the frame (23) contacting the side of the elastic member (24).

In the normal erected state of membrane structure, the skirt material 3*a* is brought in contact with a floor surface as shown by a dotted line, but for moving the structure the skirt material (3*a*) is folded and engaged with the top of the frame (23) as shown by a solid line. Then, the air at a higher pressure than the atmospheric pressure within the pneumatically supported membrane structure passes through the air passage hole (25) into the cavity within the elastic member (24), so that the protrusion 24*a* is kept in a pressure contact with the floor surface due to the inner pressure and also rises up as shown in FIG. 11, and hence the frame (23) floats up, so that movement of the membrane structure can be performed easily.

In FIG. 11, reference numeral (26) designates a guide frame associated with the frame (23), which guide frame is engaged with a guide rope (27) that is preliminarily placed on the floor surface, and performs the function of preventing lateral rocking upon movement. It is to be noted that the elastic member (24) also serves as a water stoppage packing.

A sixth preferred embodiment of the present invention is illustrated in FIGS. 13 to 15, in which a frame (28) is constructed of soft tubes made of rubber, canvas, etc. and mounted on the lower edge of a membrane material (3), air is fed into the frame (28) by means of a fan (29), and the air is further fed to within the membrane structure through bores (30) provided in the frame (28).

The above-described tube is held at a pressure that is higher than the pressure within the membrane structure and that can maintain the shape of the frame, and it makes it possible to feed air to within the membrane structure at a sufficient flow rate. To that end, open/-shut gates are provided at a number of tubes and a large number of bores having a small diameter are drilled.

In the case of employing a pneumatically supported membrane structure which is to be moved, depending upon the kind of work it may be necessary to avoid contact of the foot wheels or the with a finished surface. In such a case, the frame is not formed as a completely rigid body but is formed as an elastically deformable structure to a certain extent. Thereby, a desired portion of the frame is deformed upwardly by effecting an appropriate weight distribution over the frame, so that the membrane structure can be moved without contacting a finished surface.

FIG. 15 shows the preferred embodiment for use in the above-mentioned case. In the case where it is to be avoided foot wheels along the opposite end edge frame portions of the pneumatically shaped membrane structure with a paved surface or the like is to be avoided, weight distribution is made such that the weight w upon the longitudinal edge frame portions is made larger than the floating force P exerted upon these frame portions ($f=P_i r$, $P_i$ being the inner pressure, r being the radius of curvature of the structure) and the weight w' loaded upon the end edge frame portions is made smaller than the floating force exerted upon the same portions, so that the end edge frame portions are bent upwardly, and thereby foot wheels at these frame portions are made unnecessary.

While the pressure invention has been described above in connection to its preferred embodiments, it is intended that the invention should not be limited to the illustrated embodiments, but that various changes and modifications in design could be made without departing from the spirit of the present invention.

What is claimed is:

1. An apparatus for moving a pneumatically supported flexible membrane structure supported solely by pneumatic pressure within the membrane, comprising:

a rigid frame positioned only along the lower edge of substantially the entire periphery of said membrane structure and which the lower edge portion of said membrane structure is attached;

a plurality of wheeled supporting means at intervals around substantially the entire periphery of said membrane structure and having only floor engaging idler wheels and mounted on said frame and being the sole means for supporting said frame, said wheeled supporting means supporting said frame slightly above the floor or ground on which said membrane structure is positioned so that said frame can be moved across the floor or ground; and water stopping packing means on the bottom of said frame for engaging the floor or ground when the frame is at a position on the floor or ground where the membrane structure is to be positioned.

2. An apparatus as claimed in claim 1 in each said wheeled supporting means comprises a jack means mounted on said frame and a wheel thereon, said jack means being operable for raising said frame from a position where said packing means are engaged with the floor or ground to a position where the packing means are spaced above the floor or ground, whereby the frame and the membrane structure can be wheeled across the floor or ground.

3. An apparatus as claimed in claim 1 in which each said wheeled supporting means comprises a wheel carrying member mounted on said frame and having a pair of wheels thereon on opposite sides of the length of said frame and supporting the bottom of the frame at a position spaced above the floor or ground, and said packing means comprises a packing removably inserted between the frame and the floor or ground for sealing the space therebetween and being removable for permitting the frame and membrane structure to be wheeled across the floor or ground.

* * * * *